US010125599B2

(12) United States Patent
Goodwin

(10) Patent No.: US 10,125,599 B2
(45) Date of Patent: Nov. 13, 2018

(54) LOCATION OF SENSORS IN WELL FORMATIONS

(71) Applicant: MICROSS ADVANCED INTERCONNECT TECHNOLOGY LLC, Durham, NC (US)

(72) Inventor: Scott Goodwin, Hillsborough, NC (US)

(73) Assignee: MICROSS ADVANCED INTERCONNECT TECHNOLOGY LLC, Durham, NC (US)

( * ) Notice: Subject to any disclaimer, the term of this patent is extended or adjusted under 35 U.S.C. 154(b) by 670 days.

(21) Appl. No.: 14/417,674

(22) PCT Filed: Aug. 1, 2013

(86) PCT No.: PCT/US2013/053291

§ 371 (c)(1),
(2) Date: Jan. 27, 2015

(87) PCT Pub. No.: WO2014/022705

PCT Pub. Date: Feb. 6, 2014

(65) Prior Publication Data

US 2015/0211358 A1 Jul. 30, 2015

Related U.S. Application Data

(60) Provisional application No. 61/678,793, filed on Aug. 2, 2012.

(51) Int. Cl.
*E21B 47/09* (2012.01)
*E21B 47/12* (2012.01)

(52) U.S. Cl.
CPC ..... *E21B 47/09* (2013.01); *E21B 47/122* (2013.01); *E21B 47/124* (2013.01)

(58) Field of Classification Search
CPC ..... E21B 47/09
(Continued)

(56) References Cited

U.S. PATENT DOCUMENTS 4,783,771 A 11/1988 Paulsson
5,113,996 A 5/1992 Gregory et al.
(Continued)

FOREIGN PATENT DOCUMENTS

WO 2008081373 A2 7/2008
WO 2011109014 A1 11/2011

OTHER PUBLICATIONS

European Search Report and Written Opinion dated Jun. 17, 2016 from related European Application No. 13825224.2.
(Continued)

*Primary Examiner* — Steven Lim
*Assistant Examiner* — Kam Ma
(74) *Attorney, Agent, or Firm* — Olive Law Group, PLLC

(57) ABSTRACT

Systems and methods for determining the location of sensors embedded in material surrounding a well. In an example system, at least one seismic signal generator is configured to generate a seismic wave signal to communicate information that enables the determination of the sensor location to the sensor. A sensor location apparatus is provided and configured to lower the at least one seismic signal generator into the subsurface structure. A sensor location controller is provided in the sensor location apparatus and configured to actuate generation of the seismic wave signal as the at least one seismic signal generator is lowered into the well.

17 Claims, 7 Drawing Sheets

(58) Field of Classification Search
USPC ..... 367/83
See application file for complete search history.

(56) References Cited

U.S. PATENT DOCUMENTS

| | | | | |
|---|---|---|---|---|
| 5,248,857 | A * | 9/1993 | Ollivier | G01H 1/003 175/40 |
| 5,924,049 | A * | 7/1999 | Beasley | G01V 1/003 367/56 |
| 7,424,928 | B2 * | 9/2008 | Cox | G01V 1/523 181/108 |
| 8,107,317 | B2 * | 1/2012 | Underhill | G01V 1/42 181/101 |
| 8,226,328 | B2 * | 7/2012 | Thompson | G01V 1/201 367/15 |
| 9,310,505 | B2 * | 4/2016 | Underhill | G01V 1/42 |
| 2003/0026166 | A1 | 2/2003 | Aronstam | |
| 2003/0043055 | A1 | 3/2003 | Schultz et al. | |
| 2004/0076077 | A1 * | 4/2004 | Robertsson | G01V 1/286 367/15 |
| 2006/0062084 | A1 * | 3/2006 | Drew | G01V 1/008 367/68 |
| 2006/0209635 | A1 * | 9/2006 | Geerits | G01V 1/44 367/25 |
| 2008/0106973 | A1 * | 5/2008 | Maisons | G01V 1/40 367/25 |
| 2008/0149329 | A1 * | 6/2008 | Cooper | E21B 43/267 166/250.01 |
| 2008/0159075 | A1 * | 7/2008 | Underhill | G01V 1/26 367/50 |
| 2009/0242205 | A1 * | 10/2009 | Coste | G01V 1/52 166/308.1 |
| 2009/0299637 | A1 * | 12/2009 | Dasgupta | G01V 1/008 702/12 |
| 2009/0326895 | A1 * | 12/2009 | Beasley | G01V 1/36 703/10 |
| 2010/0268470 | A1 | 10/2010 | Kamal et al. | |
| 2011/0176383 | A1 * | 7/2011 | Jewell | G01V 1/3852 367/16 |
| 2012/0127827 | A1 * | 5/2012 | Underhill | G01V 1/26 367/25 |
| 2012/0250455 | A1 * | 10/2012 | Djikpesse | G01V 1/28 367/14 |
| 2012/0273192 | A1 * | 11/2012 | Schmidt | E21B 47/122 166/250.1 |

OTHER PUBLICATIONS

International Search Report and Written Opinion dated Oct. 24, 2013 for PCT/US2013/053291.

European Examination Report dated Jul. 24, 2017 from related European Application No. 13825224.2.

* cited by examiner

LOCATION OF SENSORS IN WELL FORMATIONS

CROSS-REFERENCE TO RELATED APPLICATIONS

This application is the national stage of International Application No. PCT/US2013/053291, filed Aug. 1, 2013, titled "LOCATION OF SENSORS IN WELL FORMATIONS," which claims priority of U.S. Provisional Patent Application Ser. No. 61/678,793, filed on Aug. 2, 2012, titled LOCATION OF SENSORS IN WELL FORMATIONS, the contents of both of which are incorporated by reference in this application in their entireties.

TECHNICAL FIELD

The present invention relates generally to systems and methods for monitoring well formations, and more particularly, to locating sensors used in gathering data in well formations.

BACKGROUND

The construction of subsurface structures, such as wells for extracting oil, gas, water, minerals, or other materials, or for other purposes, typically involves substantial data gathering and monitoring. The data-gathering and monitoring may involve data relating to a wide variety of physical conditions and characteristics existing in the subsurface structure. Different types of sensors may be used and some may require placement inside the subsurface structure.

Recent advances in semiconductor technology and in nanotechnology have led to the development of extremely small sensors that are able to penetrate porous rock and other subsurface materials. The extent to which the sensors can penetrate the subsurface material in itself provides useful information about the subsurface material. The sensors may also be configured to measure various environmental variables such as temperature, pressure, pH, shear, salinity, and residence time.

These extremely small sensors may be injected in the subsurface material by pushing the sensors through fissures and cracks in the subsurface material using a fluid, such as water. The fluid containing the sensors is pumped into the subsurface structure. The sensors are pushed into the porous subsurface material and acquire data based on the specific sensor type. When the fluid is flushed out of the subsurface structure, the sensors are extracted from the fluid. The data collected by the sensors would then be read from the sensors.

One problem with injecting the sensors into the subsurface material is that it is difficult to determine the location of the sensors in the subsurface material at the time the data was gathered. There is a need for a way of determining the location of the sensors in the subsurface material as the sensors gather data.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a system is provided for determining the location of sensors embedded in material surrounding a well. In an example system, at least one seismic signal generator is configured to generate a seismic wave signal to communicate information that enables the determination of the sensor location to the sensor. A sensor location apparatus is provided and configured to lower the at least one seismic signal generator into the subsurface structure. A sensor location controller is provided in the sensor location apparatus and configured to actuate generation of the seismic wave signal as the at least one seismic signal generator is lowered into the well.

According to another implementation, a method is provided for determining the location of a plurality of sensors embedded in a subsurface material surrounding a well. At least one seismic signal generator is lowered into the well. At selected depths, a seismic wave signal is transmitted into the subsurface material surrounding the well. The transmitted seismic wave signal is configured to communicate information to enable determination of the location of the sensor that receives the seismic wave signal. The fluid and the sensors are then extracted from the well. The information on each sensor is used to determine the location of the sensor.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Disclosed herein are systems, methods, and apparatuses for locating sensors in a subsurface structure. Examples of the systems, methods, and apparatuses may be used in any subsurface structure in which sensors are embedded, or injected into the material of the structure or the material surrounding the structure. The description below refers to a well for petroleum or gas as an example of a subsurface structure in which advantageous use may be made of the examples described below. It is to be understood that the reference to wells or any other example structure is without limitation. The systems, methods and apparatuses may be used in structures other than wells, or any other specifically mentioned structure.

Sensors of the types described below may be used to detect a variety of parameters relating to the material and environment surrounding the sensors when injected into the subsurface material. In a well for oil or gas extraction, the sensors may be configured to measure variables such as temperature, pressure, pH, shear, salinity, and residence time. It is to be understood by those of ordinary skill in the arts that example variables are noted here without limitation. The sensors may be configured to measure any suitable variable whether or not it is mentioned.

Figure 1:
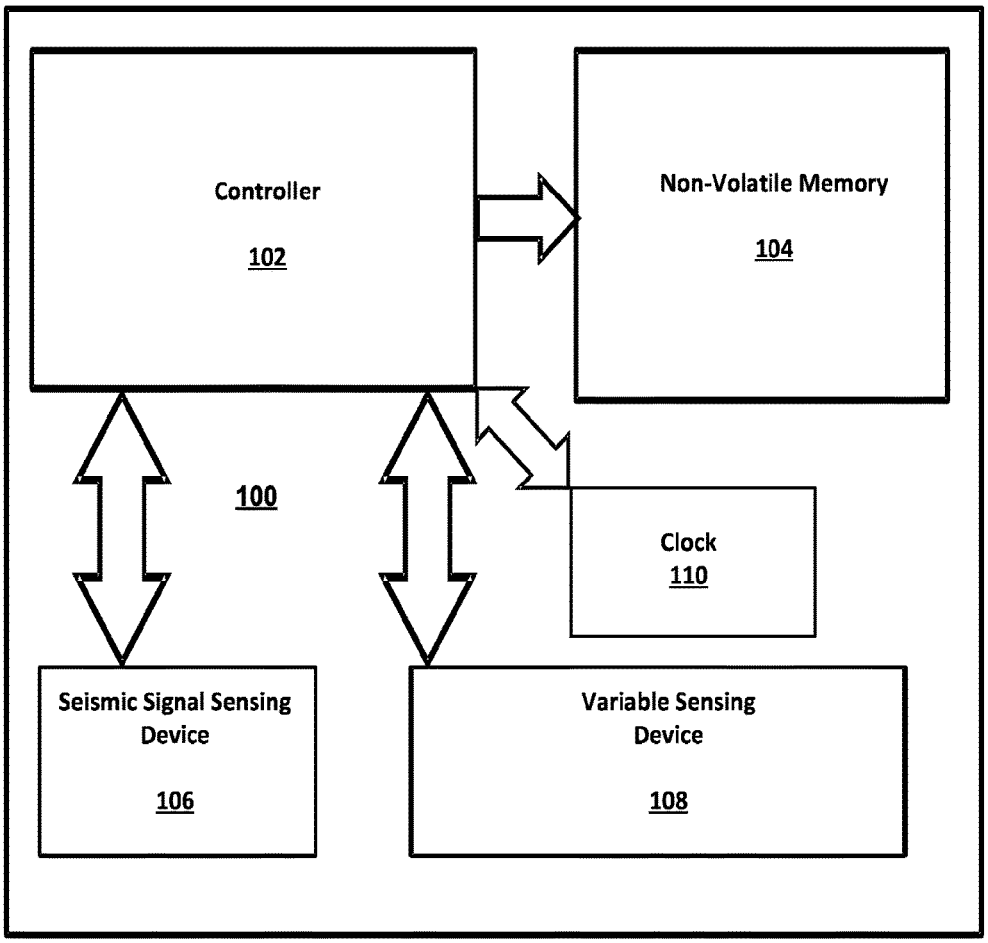
FIG. 1 is a block diagram of an example of a sensor that may be used to collect data from subsurface structures.

FIG. 1 is a block diagram of an example of a sensor 100 that may be used to collect data from subsurface structures. In an example implementation, the sensor 100 may be a semiconductor or a "chip." In another example implementation, the sensor 100 may be a "nanoparticle" manufactured using nanotechnology to achieve ultra-miniature sizes for each sensor device. The sensor 100 may be used in a batch of many sensors 100 that is injected into the subsurface material, such as the rock surrounding a well. The batch of sensors 100 may be mixed in with water or other suitable fluid. The water is then pumped into the well and the pressure of the water pushes the sensors into the rock surrounding the well. The sensors 100 collect information once embedded in the rock structure. The sensors 100 are extracted by drawing the water out of the well. The sensors 100 are removed from the fluid and read to obtain the data collected by the individual sensors. The data can be read by either a RF wireless link or by probing small pads that are exposed on the sensor. If a RF wireless link is used the sensor will include an antenna and the associated electronics connected to the antenna that will drive it.

A variety of sensor components may be implemented on the sensor 100 depending on the functions that are to be performed by the sensor 100. The sensor 100 in FIG. 1 includes a controller 102, a non-volatile memory 104, a seismic signal sensing device 106, a variable sensing device 108, and a clock 110. The controller 102 may be configured on the sensor 100 to provide processing functions, which may include administrative and maintenance functions for the sensors 100 as well as application-specific functions, such as functions for variable data gathering, storage and managing. Any suitable processor may be implemented; however, a small processing unit having processing capabilities closely scaled to the functional needs of the application may be most suitable as the application involves an environment of limited power, size and function.

The non-volatile memory 104 may be provided for storage of data gathered by the individual sensor components on the sensor 100 as described in further detail below. The non-volatile memory 104 may also store identifying information (such as a serial number) and other administrative information that may be managed or used by the controller 102.

The seismic signal sensing device 106 may be any suitable sensing device or component for sensing a seismic wave. Example implementations use MEMS ("microelectromechanical systems") technology for suitable sensors. The seismic signal sensing device 106 may be an accelerometer, a pressure sensor, or any other type of component that can sense seismic waves. Accelerometers may be constructed with a small proof mass that is suspended with flexible beams that allow the mass to move in one direction. The deflection of the mass may be measured capacitively or with piezo-resistors. Pressure sensors typically have small diaphragms with either a capacitive readout or piezo-resistor bridge to sense the deflections of the diaphragm. The seismic signal sensing device 106 may be configured to measure in three dimensions. For example, one or more accelerometers may be aligned with each of the three spatial axes. The measurements of the three groups of accelerometers may then be used to calculate the precise magnitude and direction of the seismic wave.

The variable sensing device 108 may be any suitable sensor component configured to measure a variable relating to desired information about the environment surrounding the sensor 100. The variable sensing device 108 may be a temperature sensor, a pressure sensor, a pH sensor, or any other type of sensor. In an example implementation, the variable sensing device 108 is not included and the seismic signal sensing device 106 is used for detecting pressure or seismic activity in addition to detecting seismic wave signals for locating the sensor 100 as described below.

The clock 110 may be a suitable processor clock for enabling the processing unit in the controller 102 to operate. The clock 110 may also include counting and timing functions for performing time-related functions as described below.

The sensor 100 in FIG. 1 is shown in block diagram form; accordingly, a description of the physical structure of the sensor 100 is not provided. Those of ordinary skill in the art will understand that the sensor 100 may be configured in a manner that would permit the sensor 100 to fit in the openings of porous rock or other subsurface material. The sensor 100 may have a round shape, or configured with a shape that reduces the likelihood that the sensors 100 will get stuck in cracks in the formation. The sensors 100 may be passivated, such as for example, by coating the sensors 100 with a coating (such as for example, an epoxy coating) that protects the sensors 100 from elements in the environment of the formation that may have a destructive effect on the sensors 100. Such elements include, for example, certain fluids, pH, abrasion, and heat. The passivation may accommodate a portal, or some other form of access for measurement of sensor parameters. The sensors 100 are injected into the subsurface material and systems, methods and apparatuses consistent with examples described below may be used to determine their location in the material when the sensors 100 gather their data.

The sensor 100 may be provided with a power source, which may be a battery. The power source may be connected to a circuit that maintains the power in an 'off' or low power state. The power may be turned to an 'on' state when the sensor 100 initially detects a seismic wave signal.

Figure 2:
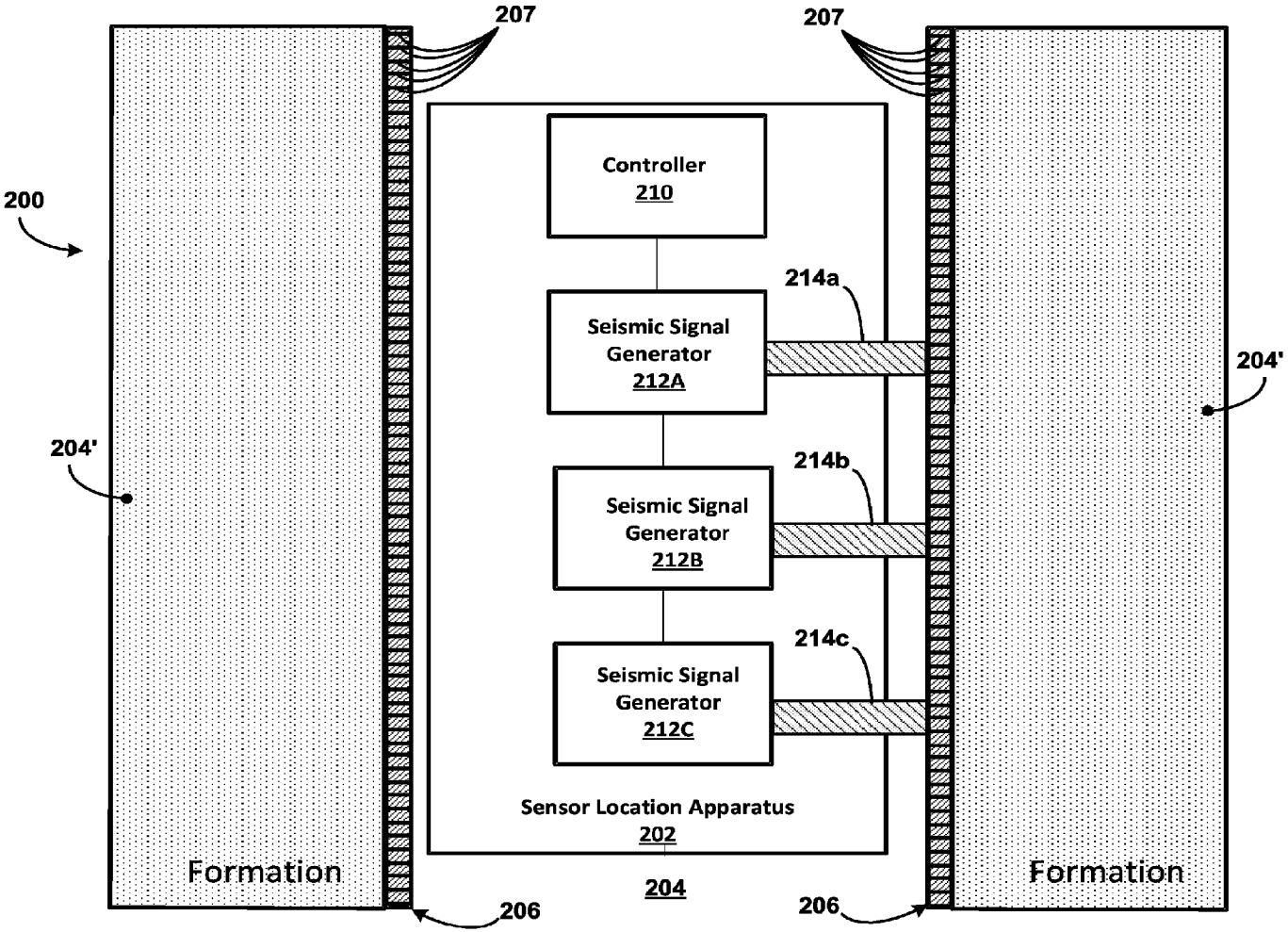
FIG. 2 is a schematic diagram of an example of a system for locating sensors in a subsurface structure.

FIG. 2 is a schematic diagram of an example of a system 200 for locating sensors in a subsurface structure. The system 200 in FIG. 2 includes a sensor location apparatus 202 disposed inside a well 204 supported by a well casing 206. The well casing 206 may be perforated with multiple casing openings 207 in selected regions where the sensors 100 will move into the formation material 204'. The multiple casing openings 207 are shown as distributed throughout the casing 206 in FIGS. 2-5, however, the multiple casing openings 207 may be distributed selectively depending on where the sensors 100 are to be dispersed. The well 204 is a substantially cylindrical opening into well formation material 204'. The sensor location apparatus 202 includes a locating apparatus controller 210, and at least one seismic signal generator 212. The system 200 in FIG. 2 depicts the example sensor location apparatus 202 as having 3 seismic signal generators 212*a*, 212*b*, and 212*c*. Any suitable number seismic signal generators 212 may be implemented.

The sensor location apparatus 202 may include structure for descending the sensor location apparatus 202 into the well 204. The function of lowering the sensor location apparatus 202 may involve an attached cable, rope, pipe, or other device for suspending the sensor location apparatus 202 during the descent of the sensor location apparatus 202 into the well 204 using methods well known to the industry. During the descent of the sensor location apparatus 202 into the well 204, the depth of each seismic signal generator 212 is monitored and recorded each time the seismic signal generator 212 performs measurement functions. The monitoring of the depths may be performed by the sensor location apparatus controller 210, or by each seismic signal generator 212. The sensor location apparatus 202 may include an enclosure for the sensor location apparatus controller 210 and the at least one seismic signal generator 212*a-c*, or for the at least one seismic signal generator 212*a-c*. The enclosure may be sealed sufficiently to keep moisture away from the at least one seismic signal generator 212*a-c* for applications in which the sensor location apparatus 202 is to be submerged in water or other fluid in the well 204.

In operation, the sensor location apparatus 202 is lowered into the well 204 after a batch of sensors 100 (in FIG. 1) has been injected into the well formation material 204'. The fluid used to inject the sensors 100 into the well formation material 204' may still be in the well 204 when the sensor location apparatus 202 is used. The sensor location apparatus controller 210 provides control over the function of locating the sensors 100 by controlling the seismic signal generators 212. The sensor location apparatus controller 210 includes hardware and software components that control the seismic signal generators 212 to generate seismic signals at predetermined times or depths as the sensor location apparatus 202 proceeds downward through the well 204.

Each of the three seismic signal generators 212*a-c* in FIG. 2 include a seismic signal conduction path 214*a-c* used by each seismic signal generator 212*a-c* to transmit seismic signals into the well formation material 204'. The seismic signal generators 212*a-c* may be configured to generate seismic wave signals to communicate an identifier that may subsequently be used by the sensor 100 that receives the identifier to determine the depth at which the identifier was transmitted. The seismic wave signals may also be used to enable the sensor 100 to determine the distance between the sensor location apparatus 202 and the sensor 100. Examples of the use of an identifier and of the determination of the distance to the sensor 100 are discussed below with reference to FIGS. 6A and 6B.

The seismic signal generators 212*a-c* may generate the seismic signals based on coding information, which may be communicated from the sensor location apparatus controller 210 or managed by the individual seismic signal generator 212*a-c*. The coding information may include a correspondence between the identifier and a depth at which the seismic wave signal was transmitted. The seismic wave signal transmitted by the seismic signal generators 212*a-c* may be modulated to include the coding information. The coding information may then be extracted by the sensors 100 by demodulating the seismic wave signal. The coding information may include any suitable information. In an example implementation, the coding information includes an identifier that may be used to determine the depth in the well 204 at which the seismic wave signal was transmitted. This depth would correspond at least approximately to the depth of the sensor or sensors 100 in the well formation material 204' that received the seismic wave signal. The depth information would then be stored in the non-volatile memory 104 along with any variables measured at that time.

The seismic signal generators 212*a-c* may also generate any other coded, or uncoded, seismic wave signals for any other function that includes communicating with the sensors 100. For example, the seismic signal generators 212*a-c* may transmit a seismic wave signal having both p-wave and s-wave components. The p-wave and s-wave components are elastic seismic waves that may be generated to propagate in the subsurface. The p-waves are formed from alternating compressions and rarefactions. The s-waves are elastic waves that move in a direction that is perpendicular to the direction of the wave as a shear or transverse motion. As the p-wave and s-wave components travel in the well formation material 204', the velocity of the p-waves is about twice the velocity of the s-waves. This difference in velocity allows the sensor 100 to calculate the distance between the seismic signal generator 212 and the sensor 100. When the sensor 100 detects the p-wave, the sensor begins a timer, which is triggered to stop when the sensor 100 detects the s-wave. The following equation would enable the sensor 100 to determine the distance, d, between the seismic signal generator 212 and sensor 100:

$$d=(V_p-V_s)\times T, \qquad \text{Eqn. (1)}$$

where, $V_p$=p-wave velocity, and $V_s$=s-wave velocity,

T=time elapsed between detecting p-wave and detecting s-wave.

The calculated distance d, would then be stored in the non-volatile memory 104, along with any variables measured at that time.

It is noted that FIG. 2 shows a cross-sectional view of the well 204 with the well formation material 204' that surrounds the well 204 shown on opposite sides of the well 204. The well 204 being a substantially cylindrical opening has well formation material 204' surrounding the opening. The sensors injected into the well formation material 204' would move through the material surrounding the well 204. While the seismic signals will likely propagate in all directions once they enter the well formation material, the seismic signal generators 212*a-c* may be configured to turn radially to provide more direct signal paths into the well formation material 204' completely surrounding the well 204. Alternatively, the seismic generators 212*a-c* and associated signal conduction paths 214*a-c* can be positioned circumferentially, projecting the signal in different radial directions, on the signal location apparatus 202 so that there is no need to rotate the apparatus.

Figure 3:
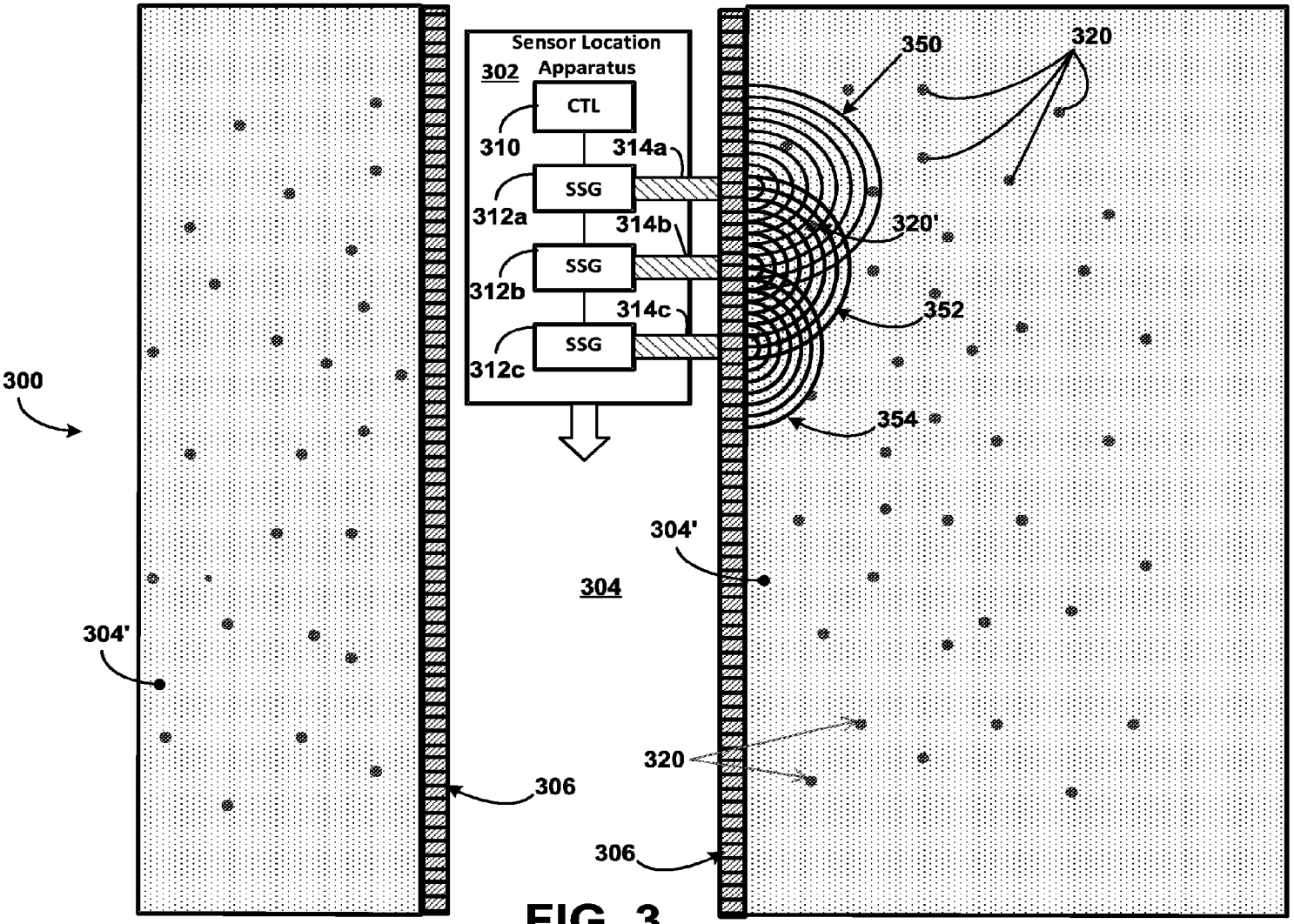
FIG. 3 is a schematic diagram illustrating operation of an example of a system for locating sensors in a subsurface structure.

FIG. 3 is a schematic diagram illustrating operation of an example of a system 300 for locating sensors 320 in a subsurface structure. The system 300 shown in FIG. 3 includes a sensor location apparatus 302 being lowered into a well 304 formed in a well formation material 304' and supported by a casing 306. Similar to the system 200 shown in FIG. 2, the sensor location apparatus 302 includes a controller 310 and three seismic signal generators 312*a-c*, which include signal conduction paths 314*a-c*. FIG. 3 also shows the sensors 320 after having been injected into the well formation material 304'.

In operation, the sensor location apparatus 302 is being lowered into the well 304. At selected depths or depth intervals, the seismic signal generators 312*a-c* transmit seismic wave signals into the well formation material 304'. In the example illustrated in FIG. 3, the seismic wave signals are transmitted by the seismic signal generators 312*a-c* at different times. A first seismic wave signal 350 is transmitted first. At a time interval later, a second seismic wave signal 352 is transmitted. At the time interval after the transmission of the second seismic wave signal 352, a third seismic wave signal 354 is transmitted.

The known time intervals and the measurement of the time of the conduction of the transmitted signals may be used to determine the location of the sensors 320. For example, the seismic signal generators 312*a-c* may be programmed to transmit seismic wave signals in a sequence separated by predetermined, fixed time intervals. Sensor 320' in FIG. 3 is receiving the first seismic wave signal 350 transmitted by the first seismic signal generator 312*a*. The sensor 320' may determine the elapsed time from the receipt of the p-wave to the receipt of the s-wave in the first seismic wave signal 350 and identify the time as the first s-wave time, $t_{s1}$. The sensor 320' may also then receive the second seismic wave signal 352 from the second seismic signal generator 312*b*. The sensor 320' may determine the elapsed time from the receipt of the p-wave of the second seismic wave signal 352 to the s-wave, and identify the time as the second s-wave time, $t_{s2}$. The time between the transmission of the first seismic wave signal 350 and the transmission of the second seismic wave signal 352 is known, allowing the sensor 302' to distinguish the two seismic wave signals 350, 352 while measuring the s-wave times. The velocity of the first and second seismic wave signals 350, 352 is also known. The distance between the ends of the signal conduction paths 314*a* and 314*b* are also known at the times of the signal transmissions. The difference between $t_{s1}$ and $t_{s2}$ may then be used in a triangulation to determine the precise location of the sensor 320'.

Figure 4:
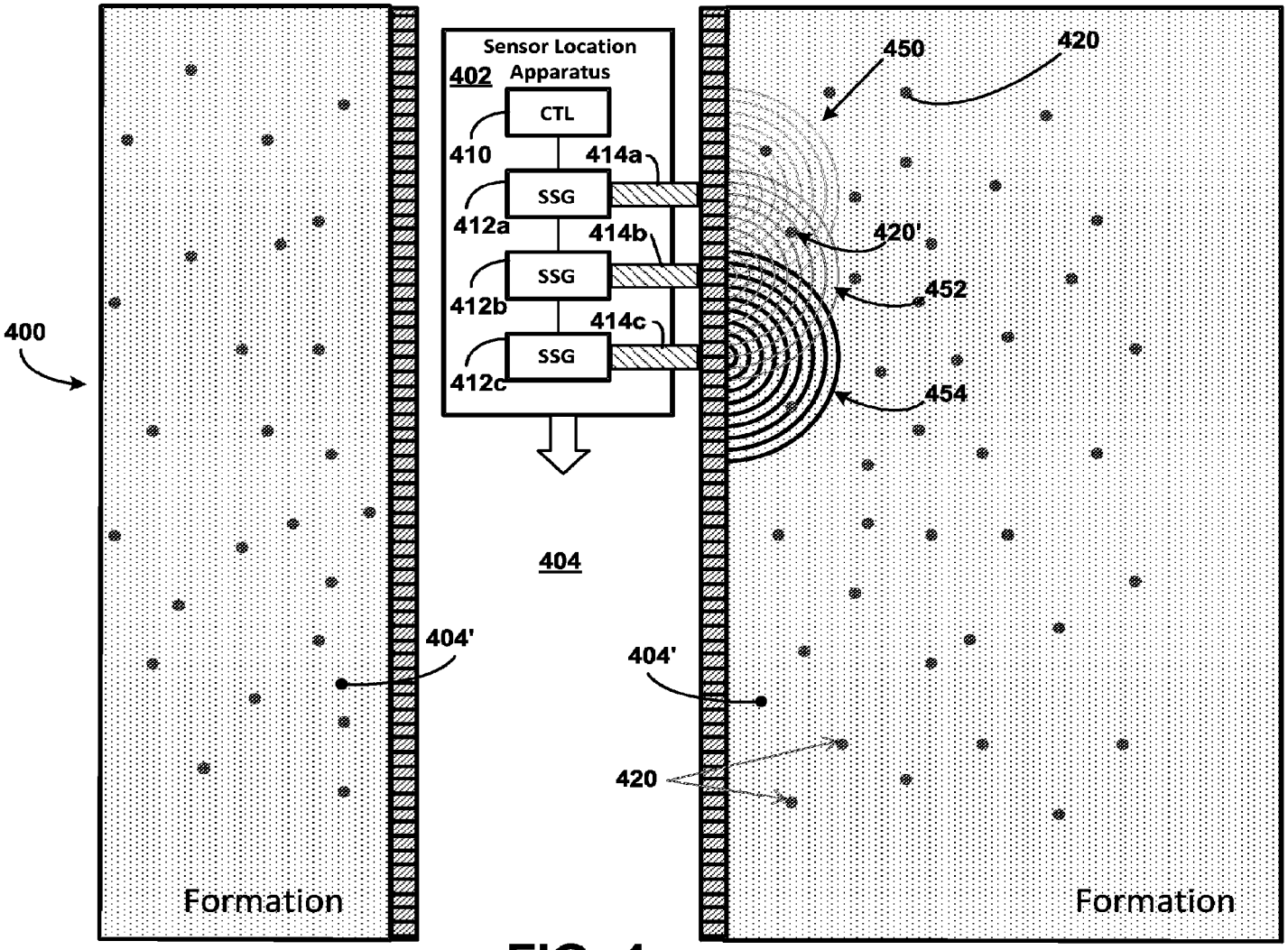
FIG. 4 is a schematic diagram illustrating operation of another example of a system for locating sensors in a subsurface structure.

FIG. 4 is a schematic diagram illustrating operation of another example of a system 400 for locating sensors in a subsurface structure. The system 400 shown in FIG. 4 includes a sensor location apparatus 402 being lowered into a well 404 formed in a well formation material 404' and supported by a casing 406. Similar to the system 200 shown in FIG. 2, the sensor location apparatus 402 includes a controller 410 and three seismic signal generators 412*a-c*, which include signal conduction paths 414*a-c*. FIG. 4 also shows the sensors 420 after having been injected into the well formation material 404'.

In operation, the sensor location apparatus 402 is being lowered into the well 404. At selected depths or depth intervals, the seismic signal generators 412*a-c* transmit seismic wave signals into the well formation material 404'. In the example illustrated in FIG. 4, the seismic wave signals transmitted by the seismic signal generators 312*a-c* have different characteristics. For example, the seismic signal generators 412*a-c* may transmit seismic wave signals have different frequencies (indicated in FIG. 4 by the different line shading for each signal). A first seismic wave signal 450 is transmitted having a first frequency. A second seismic wave signal 452 is transmitted at a second frequency, and a third seismic wave signal 454 is transmitted at a third frequency. The use of different frequencies for each seismic wave signal 450, 452, 454 allows the sensors 420 to distinguish the signals.

The known differences in the frequencies of the seismic wave signals 450, 452, 454 and the measurement of the time of the conduction of the transmitted signals may be used to determine the location of the sensors 420. For example, the seismic signal generators 412*a-c* may be programmed to transmit seismic wave signals 450, 452, 454 either sequentially or at the same time. A sensor 420' in FIG. 4 is receiving the first seismic wave signal 450 transmitted by the first seismic signal generator 412*a*. The sensor 420' may determine the elapsed time from the receipt of the p-wave to the receipt of the s-wave in the first seismic wave signal 450 and identify the time as the first s-wave time, $t_{s1}$. The sensor 420' may also receive the second seismic wave signal 452 from the second seismic signal generator 412*b*. The sensor 420' may determine the elapsed time from the receipt of the p-wave of the second seismic wave signal 452 to the s-wave, and identify the time as the second s-wave time, $t_{s2}$. The difference in frequencies of the first and second seismic wave signals 450, 452 allows the sensor 420' to distinguish between the two signals while measuring the s-wave times. The velocity of the first and second seismic wave signals 450, 452 is known. The distance between the ends of the signal conduction paths 414*a* and 414*b* are also know at the times of the signal transmissions. The difference between $t_{s1}$ and $t_{s2}$ may then be used in a triangulation to determine the precise location of the sensor 420'.

Figure 5:
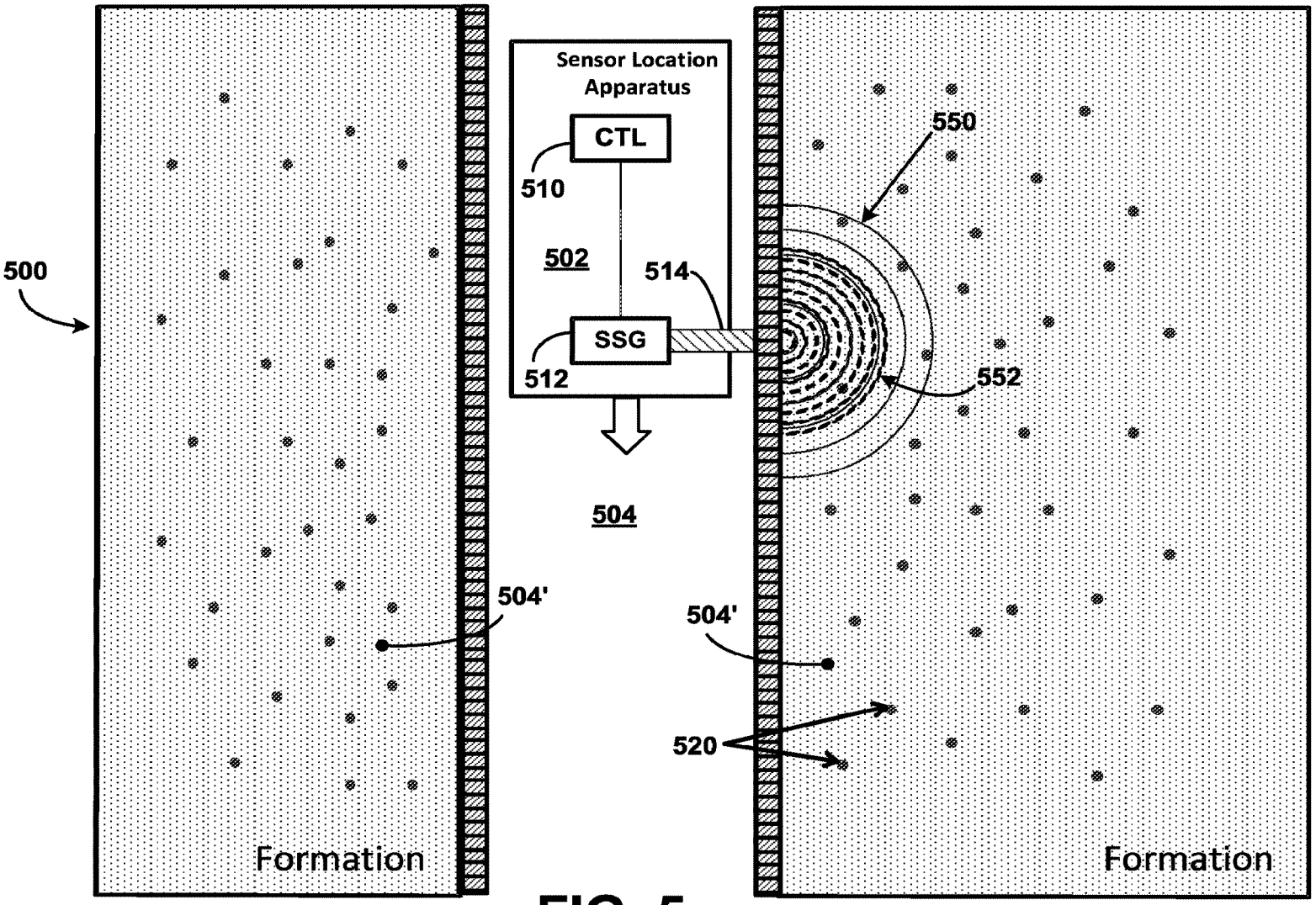
FIG. 5 is a schematic diagram illustrating operation of another example of a system for locating sensors in a subsurface structure.

FIG. 5 is a schematic diagram illustrating operation of another example of a system 500 for locating sensors in a subsurface structure. The system 500 in FIG. 5 includes a sensor location apparatus 502 having a controller 510 and a seismic signal generator 512. The sensor location apparatus 502 is lowered into a well 504 formed into a well formation material 504' supported by a well casing 506. The controller 510 in the sensor location apparatus 502 may monitor the descent of the sensor location apparatus 502 and provide program control that controls the seismic signal generator 512 during the descent.

The seismic signal generator 512 may transmit seismic wave signals 550, 552 into the well formation material 504' using a signal conduction path 514. The seismic wave signals 550, 552 may be transmitted at selected depths of the well 502. The seismic wave signals 550, 552 may include a first signal 550 having an identifier corresponding to a known depth in the well 502 at which the first signal 550 is transmitted. The seismic wave signals 552 may also include a second signal 552 having a p-wave and an s-wave component as described above with reference to FIG. 2. The p-wave and s-wave may be used to determine the distance between the sensor 520 and the seismic signal generator 512 as described above with reference to FIG. 2 and in more detail below with reference to FIGS. 6A and 6B.

Figure 6A:
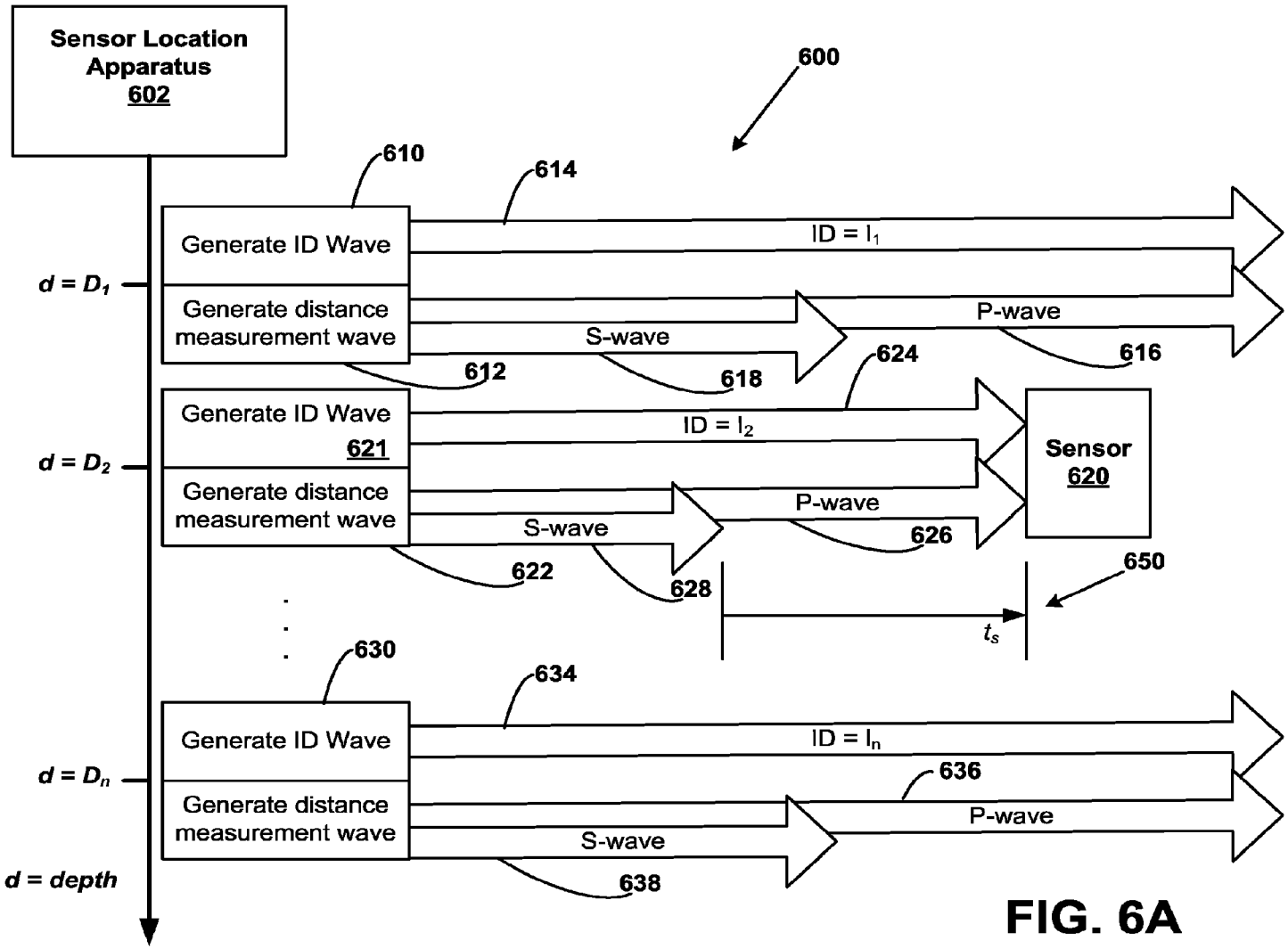
FIG. 6A is a schematic diagram illustrating operation of an example method for measuring the distance to a sensor in an example system for locating sensors in a subsurface structure.

FIG. 6A is a schematic diagram illustrating operation of an example method 600 for measuring the distance to a sensor in an example system for locating sensors in a subsurface structure. The method in FIG. 6A depicts an example sensor location apparatus 602, which in operation descends into a well as indicated by downward arrow A. At selected depths $d=D_1, D_2, \ldots D_n$, the sensor location apparatus 602 controls one or more seismic signal generators (for example, signal generator 512 in FIG. 5) to generate seismic wave signals in two steps. In a first step 610 at depth $d=D_1$, the seismic signal generator transmits a first identifier wave 614. the first identifier wave 614 may be modulated in a manner that would permit the sensor 620 to demodulate the first identifier wave 614 to extract an identifier $ID=I_1$. In a second step 612, a distance measurement wave signal is generated. The distance measurement wave signal includes a p-wave component 616 and an s-wave component 618. The first identifier wave 614 and the distance measurement wave signal may be sensed by a sensor in the well formation material.

At a second depth $d=D_2$, the seismic signal generator performs another first step 621 of generating a second identifier wave 624. The second identifier wave 624 may be modulated to have a second identifier $I=I_2$. A distance measurement wave signal may be transmitted at step 622. FIG. 6A shows sensor 620 receiving the second identifier wave 624 and a p-wave 626 and s-wave 628 in the distance measurement wave signal. The sensor 620 receives the p-wave 626 and may begin a timer to measure the time elapsed until the sensor 620 receives the s-wave 628 as shown at 650. The elapsed s-wave time, $t_s$, is used as described above with reference to FIG. 2 and Equation (1) to determine the distance from the signal source (the seismic signal generator) and the sensor 620.

The sensor location apparatus 602 may continue the control of the transmission of the seismic waves during its descent at selected depths. At depth d=Dn, in another first step 630, an n-th identifier wave 634 is transmitted into the well formation material. At step 632, an n-th distance measurement wave signal including a p-wave 636 and an s-wave 638.

It is noted that in the method 600 in FIG. 6A, the sensor 620 determines the depth of the location of the sensor 620 in the well based on the correlation of the depth with the identifier corresponding to the code modulated into the identifier wave 614, 624, 634. The sensor 620 determines its distance from the signal generator using elapsed time, $t_s$. The location of the sensor 620 relative to the opening of the well may be determined in terms of the depth of the sensor location apparatus 602 and the distance to the signal generator. The method 600 may make use of a single seismic signal generator as shown in the system 500 in FIG. 5. The seismic signal generator 512 may transmit the signals of the first and second steps shown in FIG. 6 at each of selected depths D. The method 600 may also make use of multiple seismic signal generators, such as the system 200 shown in FIG. 2. Each seismic signal generator 212*a-c* in FIG. 2 may transmit the seismic wave signals of the two steps and each seismic signal generator 212*a-c* would be at one of the selected depths D.

The method 600 assumes that the identifier wave 614, 624, 634 moves substantially horizontally and that the volume of well formation material affected by the wave can be limited. While both conditions may be controlled, another example implementation makes use of waves propagating in a larger volume and having the sensors 620 make use of multiple signal receptions.

Figure 6B:
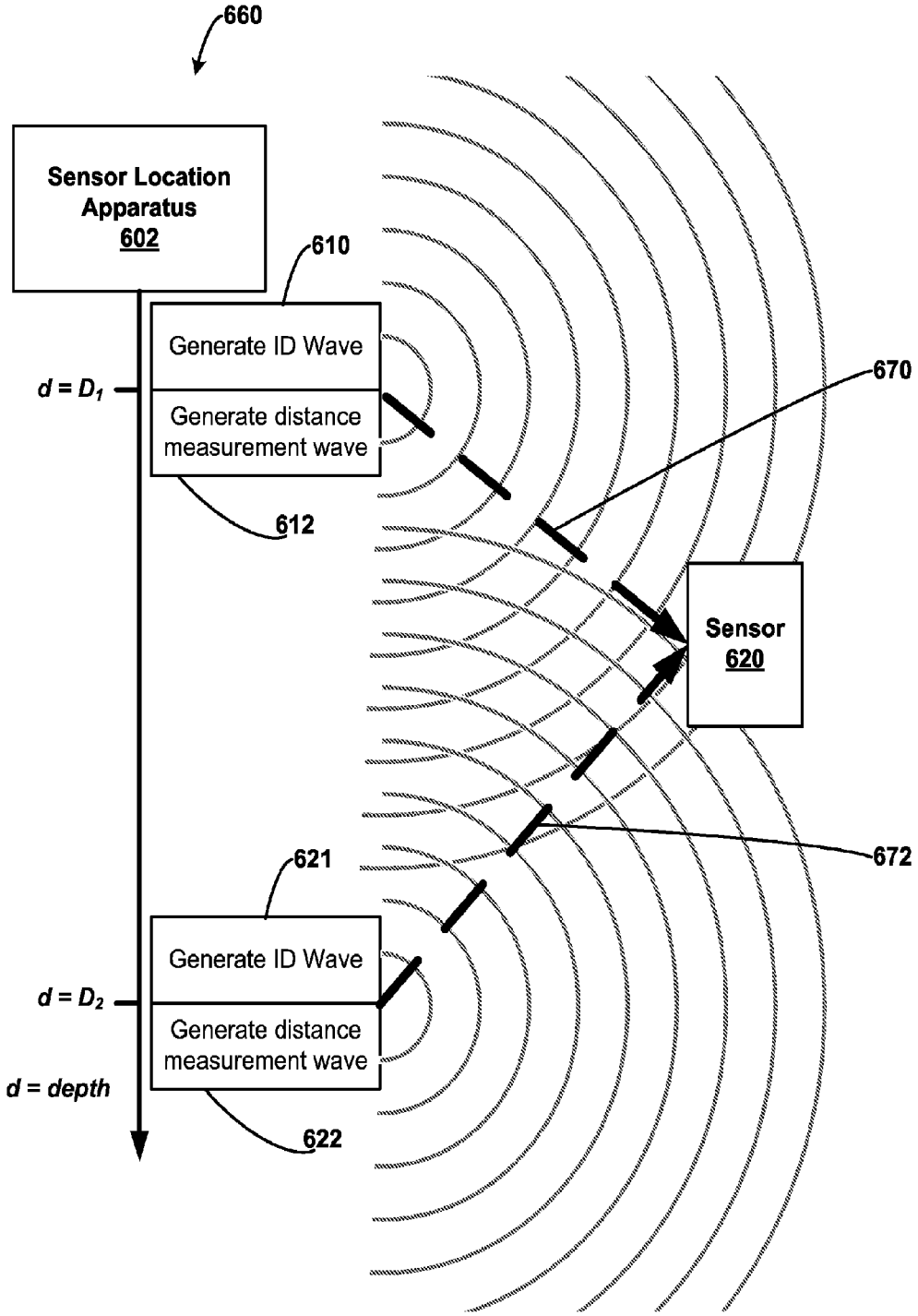
FIG. 6B is a schematic diagram illustrating operation of another example method for measuring the distance to a sensor in an example system for locating sensors in a subsurface structure.

FIG. 6B is a schematic diagram illustrating operation of another example method 660 for measuring the distance to the sensor 620 in an example system for locating sensors in a subsurface structure. FIG. 6B shows the sensor location apparatus 602 in descent similar to the illustration in FIG. 6A. At depth $d=D_1$ and $D_2$, the seismic signal generator(s) transmit the seismic wave signals through expanded volumes of well formation material. At depth $d=D_1$, a first step 610 transmits a first identifier wave as described above with reference to FIG. 6A. In a second step 612, a distance measurement wave is transmitted with a p-wave and s-wave as described above with reference to FIG. 6A. The two waves are shown in FIG. 6B combined as vector 670, which depicts the path of the wave directly to the sensor 620.

At depth d=D2, in a first step 610, a second identifier wave is transmitted by the seismic signal generator. In a second step 622, a second distance measurement signal is transmitted. The second identifier wave and the second distance measurement signal are shown in FIG. 6B combined as vector 672, which depicts the path of the wave directly to the sensor 620 at a different depth. The sensor 620 may be configured to distinguish the seismic wave signals in vector 670 from the seismic wave signals in vector 672. The distinction may be indicated in a variety of ways, including but not limited to:

1. Transmission of different identification codes between vectors 670 and 672.
2. Transmission of the first wave (vector 670) at a predetermined time interval prior to transmission of the second wave (vector 672) (as described above with reference to FIG. 3).
3. Transmission of seismic wave signals (670 and 672) having different characteristics, such as, different frequencies (as described above with reference to FIG. 4).

Elapsed s-wave times, $t_1$ and $t_2$, may be measured for vectors 670 and 672, respectively. The elapsed s-wave times, $t_1$ and $t_2$, may be used to determine the precise depth of sensor 620 between depth $D_1$ and $D_2$, and the lateral distance to the sensor 620 from the seismic signal generator in the well using triangulation as described above with reference to FIG. 4.

Example Embodiments

Example embodiments provided in accordance with the presently disclosed subject matter include, but are not limited to, the following:

A. A system for determining the location of sensors embedded in material surrounding a well, the system comprising:

at least one seismic signal generator configured to generate a seismic wave signal to communicate information to enable determination of the sensor location to the sensor;

a sensor location apparatus configured to lower the at least one seismic signal generator into the subsurface structure; and a sensor location controller configured to actuate generation of the seismic wave signal as the at least one seismic signal generator is lowered into the well.

A1. The system of embodiment A where the seismic wave signal includes a modulated seismic wave signal configured to communicate an identifier corresponding to a depth of the seismic signal generator that transmitted the seismic wave signal.

A2. The system of embodiment A where the seismic wave signal includes a seismic wave signal having a p-wave or an s-wave component.

A3. The system of embodiment A where the information communicated in the seismic wave signal is stored in the sensor.

A4. The system of embodiment A1 where the seismic signal generator is configured to transmit the modulated seismic wave signal followed by a second seismic wave signal having a p-wave or an s-wave component.

A5. The system of embodiment A1 where the modulated seismic wave signal includes a p-wave or an s-wave component.

A6. The system of embodiment A further comprising at least one additional seismic signal generator, where the at least one seismic signal generator and the at least one additional seismic signal generator are aligned vertically along a path of descent into the well at fixed distances from one another.

A7. The system of embodiment A6 where each seismic signal generator is configured to generate seismic wave signals at a frequency that is different from the frequency used by the other seismic signal generators.

A8. The system of embodiment A6 where each seismic signal generator is configured to generate seismic wave signals repeatedly with a time delay between each generation of seismic wave signals where each seismic signal generator generates the seismic wave signals by controlling the time delay to either be different from the time delay used by the other seismic signal generators, or fixed between the signals generated by the multiple seismic signal generators.

A9. The system of embodiment A where the at least one seismic signal generator is configured to rotate to transmit seismic wave signals along different angles into the well surface.

A10. The system of embodiment A where the at least one seismic signal generator comprises a plurality of signal conduction paths positioned radially around the seismic signal generator to transmit seismic wave signals at different angles without rotating.

B. A method for gathering data relating to a subsurface material surrounding a well comprising:

pumping a fluid having a plurality of sensors into the well, the sensors configured to travel into the subsurface material assisted by a force imparted by the fluid;

lowering a seismic signal generator into the well;

at selected depths, transmitting a seismic wave signal into the subsurface material surrounding the well, where the seismic wave signal is configured to communicate information to enable determination of the location of the sensor that receives the seismic wave signal;

for each sensor that received the seismic wave signal, storing the information at the sensor;

measuring a variable characteristic about the subsurface material at each sensor;

extracting the fluid and the sensors from the well; and using the information on each sensor to determine the location of the sensor.

B1. The method of embodiment B where:

the step of transmitting the seismic wave signal includes modulating the seismic wave signal to carry an identifier corresponding to a current depth of the seismic signal generator;

the step of storing includes demodulating the seismic wave signal to determine the identifier and storing the identifier in the sensor.

B2. The method of embodiment B1 where the step of storing includes determining a direction of travel for the seismic wave signal.

B3. The method of embodiment B where:

the step of transmitting the seismic wave signal includes generating the seismic wave signal with a p-wave and an s-wave;

the step of storing includes determining an elapsed time between p-wave and s-wave by performing the steps of:

detecting the p-wave at the sensor;

starting a timer when p-wave is detected;

detecting the s-wave at the sensor;

stopping the timer when the s-wave is detected; and storing the elapsed time between p-wave and s-wave detection.

B4. The method of embodiment B3 where the step of storing includes determining a direction of travel for the seismic wave signal.

B5. The method of embodiment B4 where:

the step of transmitting the seismic wave signal includes modulating the seismic wave signal to carry an identifier corresponding to a current depth of the seismic signal generator;

the step of storing for each sensor that received the seismic wave signal includes:

demodulating the seismic wave signal to determine the identifier and storing the identifier in the sensor;

comparing the identifier for the seismic wave signal with a previously stored identifier for a previously received seismic wave signal;

if the identifier is different from the previously stored identifier:

storing the identifier as a second identifier in the sensor;

performing the steps of determining the elapsed time between the p-wave and the s-wave and storing the elapsed time as a second elapsed time corresponding to the second identifier;

the step of using the information on each sensor includes:

for each sensor that stored more than one identifier, detecting the sensor location by performing a triangulation using a depth corresponding to each identifier stored in the sensor, the elapsed times corresponding to each identifier, the direction of each seismic wave signal, and the velocity of seismic waves in the subsurface material surrounding the well.

B6. The method of embodiment B further comprising:

turning power on in each sensor that receives the seismic wave signal upon receipt of the seismic wave signal.

B7. The method of embodiment B further comprising:

lowering at least one additional seismic signal generator such that the multiple seismic signal generators extend vertically in the well at fixed distances from one another.

B8. The method of embodiment B7 where each of the seismic signal generators generates the seismic wave signals at different frequencies than the other seismic signal generators.

B9. The method of embodiment B7 where each of the seismic signal generators generates the seismic wave signals repeatedly with either a time delay between seismic wave signal generations that is different than the other seismic signal generators, or a time delay that is fixed between the signals generated by the multiple seismic signal generators.

C. A method for determining the location of a plurality of sensors embedded in a subsurface material surrounding a well, the method comprising:

lowering at least one seismic signal generator into the well;

at selected depths, transmitting a seismic wave signal into the subsurface material surrounding the well, where the seismic wave signal is configured to communicate information to enable determination of the location of the sensor that receives the seismic wave signal;

extracting the fluid and the sensors from the well; and using the information on each sensor to determine the location of the sensor.

C1. The method of embodiment C where:

the step of transmitting the seismic wave signal includes modulating the seismic wave signal to carry an identifier corresponding to a current depth of the seismic signal generator;

the step of storing includes demodulating the seismic wave signal to determine the identifier and storing the identifier in the sensor.

C2. The method of embodiment C1 where the step of storing includes determining a direction of travel for the seismic wave signal.

C3. The method of embodiment C where:

the step of transmitting the seismic wave signal includes generating the seismic wave signal with a p-wave and an s-wave;

the step of storing includes determining an elapsed time between p-wave and s-wave by performing the steps of:

detecting the p-wave at the sensor;

starting a timer when p-wave is detected;

detecting the s-wave at the sensor;

stopping the timer when the s-wave is detected; and storing the elapsed time between p-wave and s-wave detection.

C4. The method of embodiment C3 where the step of storing includes determining a direction of travel for the seismic wave signal.

C5. The method of embodiment C4 where:

the step of transmitting the seismic wave signal includes modulating the seismic wave signal to carry an identifier corresponding to a current depth of the seismic signal generator;

the step of storing for each sensor that received the seismic wave signal includes:

demodulating the seismic wave signal to determine the identifier and storing the identifier in the sensor;

comparing the identifier for the seismic wave signal with a previously stored identifier for a previously received seismic wave signal;

if the identifier is different from the previously stored identifier:

storing the identifier as a second identifier in the sensor;

performing the steps of determining the elapsed time between the p-wave and the s-wave and storing the elapsed time as a second elapsed time corresponding to the second identifier;

the step of using the information on each sensor includes:

for each sensor that stored more than one identifier, detecting the sensor location by performing a triangulation using a depth corresponding to each identifier stored in the sensor, the elapsed times corresponding to each identifier, the direction of each seismic wave signal, and the velocity of p-waves in the subsurface material surrounding the well.

C6. The method of embodiment C further comprising:

turning power on in each sensor that receives the seismic wave signal upon receipt of the seismic wave signal.

D. A sensor for detecting variable conditions in a subsurface material surrounding a well, the sensor having a size small enough to travel into the subsurface material, the sensor comprising:

a controller;

a memory component for storing information;

a seismic signal sensing device configured to detect a seismic signal and connected to provide a sensor signal corresponding to the detected seismic signal to the controller; and where the controller is configured to extract information for determining the location of the sensor from the detected seismic signal and to store the information in the memory component.

D1. The sensor of embodiment D where the controller is configured to demodulate the detected seismic signal to determine an identifier that was modulated into the seismic signal by a seismic signal generator.

D2. The sensor of embodiment D where the seismic signal sensing device includes at least one seismic sensor aligned with each of the three spatial axes, the controller being further configured to determine a direction of the seismic signal based on measurements along the three spatial axes obtained from the seismic sensors.

D3. The sensor of embodiment D where the seismic signal sensing device is configured to detect a p-wave and an s-wave in the seismic signal, and to determine an elapse time between receipt of the p-wave and receipt of the s-wave.

D4. The sensor of embodiment D where the controller is configured to store information from different seismic signals transmitted from different sources.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A system for determining sensor locations in well formations, the system comprising:

one or more sensors embedded in a subsurface material surrounding a well;

at least one seismic signal generator configured to generate a seismic wave signal to communicate information to enable determination of the sensor location to the sensor;

a sensor location apparatus configured to lower the at least one seismic signal generator into the subsurface material; and a sensor location controller configured to actuate generation of the seismic wave signal while the at least one seismic signal generator is in the well in order for at least the locations of the sensors in the subsurface material surrounding the well to be obtained, wherein the seismic wave signal generated includes a modulated seismic wave signal modulated to include an identifier corresponding to a current depth of the seismic signal generator that transmitted the seismic wave signal.

2. The system of claim 1, wherein the seismic wave signal includes a seismic wave signal having a p-wave or an s-wave component.

3. The system of claim 1, further comprising at least one additional seismic signal generator, where the at least one seismic signal generator and the at least one additional seismic signal generator extend vertically along a path of descent into the well at fixed distances from one another.

4. The system of claim 3, wherein each seismic signal generator is configured to generate seismic wave signals at a frequency that is different from the frequency used by the other seismic signal generators.

5. The system of claim 3, wherein each of the seismic signal generators generates the seismic wave signals repeatedly with either a time delay between seismic wave signal generations that is different than the other seismic signal generators, or a time delay that is fixed between the signals generated by the multiple seismic signal generators.

6. The system of claim 1, wherein the at least one seismic signal generator is configured to rotate to transmit seismic wave signals along different angles into the well surface.

7. The system of claim 1, wherein the at least one seismic signal generator comprises a plurality of signal conduction paths positioned radially around the seismic signal generator to transmit seismic wave signals at different angles without rotating.

8. A method for gathering data relating to a subsurface material surrounding a well, comprising:

pumping a fluid having a plurality of sensors into the well, the sensors configured to travel into the subsurface material assisted by a force imparted by the fluid;

disposing the sensors in the subsurface material surrounding the well;

lowering a seismic signal generator into the well;

at selected depths, transmitting a seismic wave signal into the subsurface material surrounding the well, where the seismic wave signal is configured to communicate information to enable determination of the location of the sensor that receives the seismic wave signal in order for the locations of the sensors in the subsurface material surrounding the well to be obtained;

for each sensor that received the seismic wave signal, storing the information at the sensor;

measuring a variable characteristic about the subsurface material at each sensor;

extracting the fluid and the sensors from the well; and using the information on each sensor to determine at least the location of the sensor, wherein the step of transmitting the seismic wave signal includes modulating the seismic wave signal such that the seismic wave signal transmitted is modulated to include an identifier corresponding to a current depth of the seismic signal generator.

9. The method of claim 8, wherein:

the step of transmitting the seismic wave signal includes modulating the seismic wave signal to carry an identifier corresponding to the current depth of the seismic signal generator;

the step of storing includes demodulating the seismic wave signal to determine the identifier and storing the identifier in the sensor.

10. The method of claim 8, wherein:

the step of transmitting the seismic wave signal includes generating the seismic wave signal with a p-wave and an s-wave;

the step of storing includes determining an elapsed time between p-wave and s-wave by performing the steps of:

detecting the p-wave at the sensor;

starting a timer when p-wave is detected;

detecting the s-wave at the sensor;

stopping the timer when the s-wave is detected; and storing the elapsed time between p-wave and s-wave detection.

11. The method of claim 10, wherein:

the step of transmitting the seismic wave signal includes modulating the seismic wave signal to carry an identifier corresponding to the current depth of the seismic signal generator;

the step of storing for each sensor that received the seismic wave signal includes:

demodulating the seismic wave signal to determine the identifier and storing the identifier in the sensor;

comparing the identifier for the seismic wave signal with a previously stored identifier for a previously received seismic wave signal;

if the identifier is different from the previously stored identifier:

storing the identifier as a second identifier in the sensor;

performing the steps of determining the elapsed time between the p-wave and the s-wave and storing the elapsed time as a second elapsed time corresponding to the second identifier;

the step of using the information on each sensor includes:

for each sensor that stored more than one identifier, detecting the sensor location by performing a triangulation using the depth corresponding to each identifier stored in the sensor, the elapsed times corresponding to each identifier, the direction of each seismic wave signal, and the velocity of p-waves in the subsurface material surrounding the well.

12. The method of claim 8, further comprising:

turning power on in each sensor that receives the seismic wave signal upon receipt of the seismic wave signal.

13. The method of claim 8, further comprising:

lowering at least one additional seismic signal generator such that the multiple seismic signal generators extend vertically in the well at fixed distances from one another.

14. The method of claim 13, wherein each of the seismic signal generators generate the seismic wave signals at different frequencies than the other seismic signal generators.

15. The method of claim 13, wherein each of the seismic signal generators generates the seismic wave signals repeatedly with either a time delay between seismic wave signal generations that is different than the other seismic signal generators, or a time delay that is fixed between the signals generated by the multiple seismic signal generators.

16. A sensor for detecting variable conditions in a subsurface material surrounding a well, the sensor having a size small enough to travel into the subsurface material, the sensor comprising:

a controller;

a memory component for storing information; and a seismic signal sensing device configured to detect a seismic signal and connected to provide a sensor signal corresponding to the detected seismic signal to the controller;

wherein the controller is configured to extract information for determining the location of the sensor in the subsurface material surrounding the well from the detected seismic signal and to store the information in the memory component, wherein the controller is configured to demodulate the detected seismic signal to determine an identifier contained therein of a current depth of a seismic signal generator transmitting the seismic signal.

17. The sensor of claim 16, wherein the seismic signal sensing device includes at least one seismic sensor aligned with each of the three spatial axes, the controller being further configured to determine a direction of the seismic signal based on measurements along the three spatial axes obtained from the seismic sensors.

* * * * *